US008893799B2

(12) United States Patent
Garay

(10) Patent No.: US 8,893,799 B2
(45) Date of Patent: Nov. 25, 2014

(54) SUBSURFACE SAFETY VALVE INCLUDING SAFE ADDITIVE INJECTION

(75) Inventor: Serge Garay, Osserain (FR)

(73) Assignee: Weatherford/Lamb, Inc., Houston, TX (US)

( * ) Notice: Subject to any disclaimer, the term of this patent is extended or adjusted under 35 U.S.C. 154(b) by 309 days.

(21) Appl. No.: 13/351,146

(22) Filed: Jan. 16, 2012

(65) Prior Publication Data

US 2012/0193101 A1 Aug. 2, 2012

(30) Foreign Application Priority Data

Jan. 27, 2011 (FR) ..... 11 50632

(51) Int. Cl.

| | |
|---|---|
| ***E21B 34/06*** | (2006.01) |
| ***E21B 43/00*** | (2006.01) |
| ***F16K 17/00*** | (2006.01) |
| ***F16K 11/06*** | (2006.01) |
| ***E21B 34/10*** | (2006.01) |
| ***E21B 33/068*** | (2006.01) |

(52) U.S. Cl.

CPC ..... *E21B 34/10* (2013.01); *E21B 33/068* (2013.01)

USPC ..... 166/332.6; 166/310; 166/332.8; 166/334.1; 137/595; 137/607

(58) Field of Classification Search

CPC ..... E21B 34/101; E21B 34/12; E21B 34/14; E21B 2034/005

USPC ..... 166/369, 305.1, 373, 386, 332.1, 332.8, 166/334.1, 332.6, 332.7, 310, 371; 137/595, 607

See application file for complete search history.

(56) References Cited

U.S. PATENT DOCUMENTS

| | | | | | |
|---|---|---|---|---|---|
| 4,022,273 | A | | 5/1977 | Marathe | |
| 4,042,033 | A | | 8/1977 | Holland et al. | |
| 4,691,777 | A | * | 9/1987 | Williamson, Jr. | 166/319 |
| 4,703,805 | A | * | 11/1987 | Morris | 166/324 |
| 4,706,933 | A | * | 11/1987 | Sukup et al. | 251/54 |
| 4,709,762 | A | * | 12/1987 | Pringle | 166/324 |
| 4,722,399 | A | * | 2/1988 | Pringle | 166/324 |

(Continued)

FOREIGN PATENT DOCUMENTS

| | | | |
|---|---|---|---|
| GB | 2197011 | A | 5/1988 |
| WO | 2008002473 | A2 | 1/2008 |

OTHER PUBLICATIONS

French search report for application No. 1150632 dated Aug. 29, 2011.

*Primary Examiner* — Jennifer H Gay

(74) *Attorney, Agent, or Firm* — Patterson & Sheridan, L.L.P.

(57) ABSTRACT

A safety valve for an effluent-production installation, the safety valve comprising a longitudinal shell in which there extends a production tube defining an inside volume for effluent flow. The tube is movable in translation inside the shell in an axial direction between an advanced position in which effluent flow is authorized from the bottom of the installation towards the surface, and a retracted position in which effluent flow is prevented. The valve includes a connection duct between a feed line for feeding at least one additive from the surface and an injection line for injecting the additive downhole, a safety plug being provided in the connection duct in order to close or open the duct depending on whether the production tube is in its retracted position or its advanced position.

13 Claims, 7 Drawing Sheets

(56) References Cited

U.S. PATENT DOCUMENTS

| | | | | |
|---|---|---|---|---|
| 5,179,973 | A * | 1/1993 | Dickson et al. | 137/433 |
| 5,207,275 | A * | 5/1993 | Strattan et al. | 166/386 |
| 6,148,920 | A * | 11/2000 | McCalvin | 166/324 |
| 7,712,537 | B2 | 5/2010 | Hill et al. | |
| 7,963,334 | B2 * | 6/2011 | Hill et al. | 166/322 |
| 8,016,035 | B2 * | 9/2011 | Strattan et al. | 166/250.08 |
| 2005/0098210 | A1 * | 5/2005 | Strattan et al. | 137/70 |
| 2007/0277878 | A1 * | 12/2007 | Strattan et al. | 137/70 |
| 2008/0271893 | A1 * | 11/2008 | Hill et al. | 166/305.1 |
| 2010/0108320 | A1 * | 5/2010 | Larnach | 166/310 |
| 2012/0193101 | A1 * | 8/2012 | Garay | 166/321 |
| 2013/0048303 | A1 * | 2/2013 | Patel et al. | 166/373 |

* cited by examiner

SUBSURFACE SAFETY VALVE INCLUDING SAFE ADDITIVE INJECTION

CROSS-REFERENCE TO RELATED APPLICATIONS

This application claims benefit of French patent application serial number 1150632, filed Jan. 27, 2011, which is herein incorporated by reference in its entirety.

BACKGROUND OF THE INVENTION

1. Field of the Invention

Embodiments of the invention relate to a surface-controlled subsurface safety valve (SCSSV) and also to an effluent-production installation including such a safety valve. In the meaning of the invention, the term "effluent" is used more particularly to designate oil or gas, but may also apply to other fluids, such as water.

2. Description of the Related Art

SCSSVs are commonly used for shutting-off oil or gas wells. Such SCSSVs are typically installed in a production column in a hydrocarbon production well, and they have the function of blocking the upward stream of fluid formation through the production column in the event of there being a problem or a dangerous condition occurring at the surface of the well.

Typically, SCSSVs are configured so as to be rigidly connected to the production column (accessible in the column) or else they are suitable for being installed and recovered by means of a cable without disturbing the production column (recoverable by cable). During normal production, the subsurface safety valve may be held in the open position by applying hydraulic fluid pressure that is transmitted to an actuator mechanism.

The hydraulic pressure is commonly prepared by means of clean oil coming from a tank of fluid on the surface and transmitted to the SCSSV via a control line. A pump at the surface, controlled via a control panel, delivers hydraulic fluid under pressure in regulated manner. The control line is arranged inside the annular zone between the production column and the surrounding casing of the well.

The SCSSV automatically closes the production stream in response to one or more well safety conditions that may be detected and/or indicated at the surface. By way of non-limiting example, such conditions include fire on a platform, damage to the wellhead, e.g. as the result of a collision between a truck or a boat and the wellhead, a high or low pressure situation in the flow lines, a high or low temperature situation in the flow lines, or an intervention by an operator.

Such conditions lead to a drop in the hydraulic pressure in the control line, thereby causing a flap to close in such a manner as to block the upward stream of production fluids along the column. In other words, when a dangerous condition or problem occurs at the surface of a well, fluid communication between the tank on the surface and the control line is interrupted. This interrupts the application of hydraulic pressure against the actuator mechanism. The actuator mechanism retracts inside the valve, thereby enabling the flap to close against an annular seat.

Most surface-controlled subsurface safety valves are "normally-closed" valves, i.e. the valve is in its closed position whenever there is no hydraulic pressure. The hydraulic pressure typically acts against a powerful spring and/or a compressed gas via a piston.

In numerous commercially-available valve systems, the power of the spring is exceeded by the hydraulic pressure acting on the piston, thereby causing the piston to move longitudinally. In turn, the piston acts against a flow tube or production tube that is of elongate shape. In this way, the actuator mechanism comprises a piston that is hydraulically actuated and that is longitudinally movable so as to act against the flow tube in order to move it along the column and in front of the flap.

During production, the flap is held in the open position by the force of the piston acting against the end of the flow tube. The hydraulic fluid is pumped into a variable-volume compression chamber and acts against a hermetically sealed zone of the piston. In turn, the piston acts against the flow tube so as to open the flap element in the valve, in selective manner.

Any loss of hydraulic pressure in the control line causes the piston to retract and the flow tube to be actuated. This causes the flap to pivot about a hinge until the valve is in the closed position, e.g. by using a torsion spring and in response to the upwardly-flowing formation fluid.

In this way, the SCSSV can shut-off the production stream in the column when the hydraulic pressure in the control line is released. An example of a safety valve as described above is disclosed for example in FR 2 900 682 in the name of the Applicant.

At the beginning of the operation of a well, typically during its first five to ten years, the pressure of the effluent within the formation ensures that it rises in natural manner. In contrast, as the pressure decreases, it becomes necessary to perform additional operations in order to allow production to continue.

A first known solution consists in raising the safety valve and in propelling a gas downhole using the so-called "gas lift" technique, in order to cause the effluent to rise. Nevertheless, such a method is not satisfactory insofar as it is particularly complex, since it involves removing the safety valve completely.

As an alternative, proposals have also been made to inject an additive towards the effluent-containing formation, which additive is generally a chemical and serves to enhance upward flow of the fluid. It is possible firstly to pass this fluid directly via the control line.

Nevertheless, that presents several drawbacks. Thus, when additive injection is stopped, that necessarily causes the valve to close, since that is the normal position of the valve. Furthermore, when injected into the control line, certain types of additive cannot control the valve in appropriate manner, particularly if they present a high degree of viscosity.

An improvement to the solution described immediately above consists in injecting the additive via a set of ducts that are independent both from the control line and from the production tube. Such an arrangement is described in particular in U.S. Pat. No. 7,712,537.

More precisely, that document provides for injecting the additive via a line that extends axially along the production tube, while being laterally offset relative thereto. The downstream end of that line opens out into an adapter that is itself located downstream from the shutter flap associated with the production tube. Under such conditions, additive can be injected while leaving undisturbed both the flow in the control line and the upward flow of effluent in the production tube.

Nevertheless, that solution presents its own drawbacks. Thus, if the additive is not injected with sufficient pressure, the effluent present downhole is capable of rising directly via the additive injection line, if the downstream safety valve is leaky.

Furthermore, in the event of a major malfunction, e.g. if the wellhead is absent, it is no longer possible for the operator to perform the above-mentioned injection under pressure, such that the effluent can rise along the injection line. Such effluent leakage can lead to catastrophic phenomena of great magnitude, of the "oil spill" type if the effluent is oil.

Publication U.S. Pat. No. 4,022,273 discloses a safety valve including a bypass type injection line that is opened and closed in succession by movement in translation of a sleeve that is provided in the production tube with channels and orifices moving relative to one another so as to face one another or so as to be offset from one another.

Publication U.S. Pat. No. 4,042,033 also discloses a safety valve that includes a ball valve in a production line and a sleeve movable in translation in the production line to open and close a chemical additive injection line in succession. The safety valve is designed so that the production tube and the injection line are opened simultaneously and are then closed when the pressure applied by the fluid becomes less than or equal to the pressure needed for holding the ball valve open.

Publication GB 2,197,011 describes a safety valve including a flap that is tilted when a sleeve moves down inside the production tube, the sleeve having a shoulder that is suitable during downward movement of the sleeve for bearing against a ring provided on a rod that slides in a parallel pipe connecting together the portions upstream and downstream of the flap in order to balance pressures and make it easier to open the flap.

Publication WO 2008/002473 describes a device of the bypass type.

SUMMARY OF THE INVENTION

The invention seeks to remedy the various drawbacks of the prior art as mentioned above. It seeks in particular to propose a safety valve that, while suitable for being used effectively in wells near the end of life, guarantees satisfactory safety during additive injection, even under severe working conditions.

To this end, the invention provides a safety valve for an effluent-production installation, the safety valve comprising a longitudinal shell in which there extends a production tube defining an inside volume for effluent flow, the production tube being movable in translation inside the longitudinal shell in an axial direction between an advanced position in which effluent flow is authorized from the bottom of the installation towards the surface, and a retracted position in which effluent flow is prevented, the safety valve being characterized in that it further includes a connection duct between a feed line for feeding at least one additive from the surface and an injection line for injecting the additive downhole, a safety plug being provided in the connection duct and being movable in translation along the axial direction in which the production tube moves in order to close or open the connection duct depending on whether the production tube is in its retracted position or its advanced position, the production tube being arranged to push the safety plug in said axial direction on passing from its retracted position towards its advanced position, the driving connection between the production tube and the safety plug being a mechanical connection by contact.

In particular, the safety valve is suitable for passing from a closed position to an open position under the effect of the production tube going from its retracted position towards its advanced position. More particularly, the safety plug is mounted to move in the connection duct between a closed position in which it closes the connection duct and an open position in which said feed line and injection line are in communication with each other, the safety plug being drivingly connected with the production tube to pass from its closed position to its open position when the production tube passes from its retracted position to its advanced position along the axial direction.

The idea on which the invention is based is thus to provide a safety plug that is capable of stopping the flow of additive, with movement thereof being induced by movement of the production tube. Thus, when the control line is put under pressure, the production tube moves into its advanced position and forces the safety plug to occupy its open position, thereby allowing additive to flow from the surface downhole through the feed line and the injection line.

In contrast, in the event of an incident, the production tube passing into its retracted position releases the safety plug which then occupies its closed position. This then prevents additive from flowing, and also prevents any unwanted rising of effluent from downhole to the surface via the line provided for the additive. Finally, when the production tube is back into its advanced position, this is accompanied by a corresponding movement of the safety plug, thereby once more releasing the additive passage.

According to other advantageous characteristics:

the safety plug return means are provided for returning the safety plug from its open position to its closed position when the production tube is moved from its advanced position to its retracted position;

the safety plug is movable in a channel and acts in its closed position to define a main sealing zone formed by co-operation between a sharp edge belonging to a wall of the channel or to the safety plug, and a frustoconical surface belonging to the safety plug or to a wall of the channel;

the channel opens out towards the inside volume of the production tube;

the connection duct includes two lateral flow holes opening out into said channel, which holes are disposed on either side of the main sealing zone;

two secondary sealing zones are provided in addition to the main sealing zone, being located on either side of the two lateral holes;

the section of the secondary sealing zone facing downhole is greater than or equal to the section of the secondary sealing zone facing towards the surface;

the section of the secondary sealing zone facing downhole is greater than the section of the secondary sealing zone facing towards the surface, the return means for the plug being provided by a pressure difference;

the safety plug return means comprise a mechanical member, in particular of the resilient type;

the connection duct includes a pipe fitted on two sleeves placed at opposite ends of the longitudinal shell, the sleeves being constrained to move in translation with the longitudinal shell while being free to move in rotation relative to said longitudinal shell; and the safety plug is made of two distinct elements suitable for being releasably connected together, in particular by screw fastening.

The invention also provides an effluent-production installation comprising a production column and a safety valve housed in said production column, the installation being characterized in that the safety valve as specified above.

BRIEF DESCRIPTION OF THE DRAWINGS

The invention is described below with reference to the accompanying drawings given purely by way of non-limiting example, and in which.

DETAILED DESCRIPTION

Figure 1:
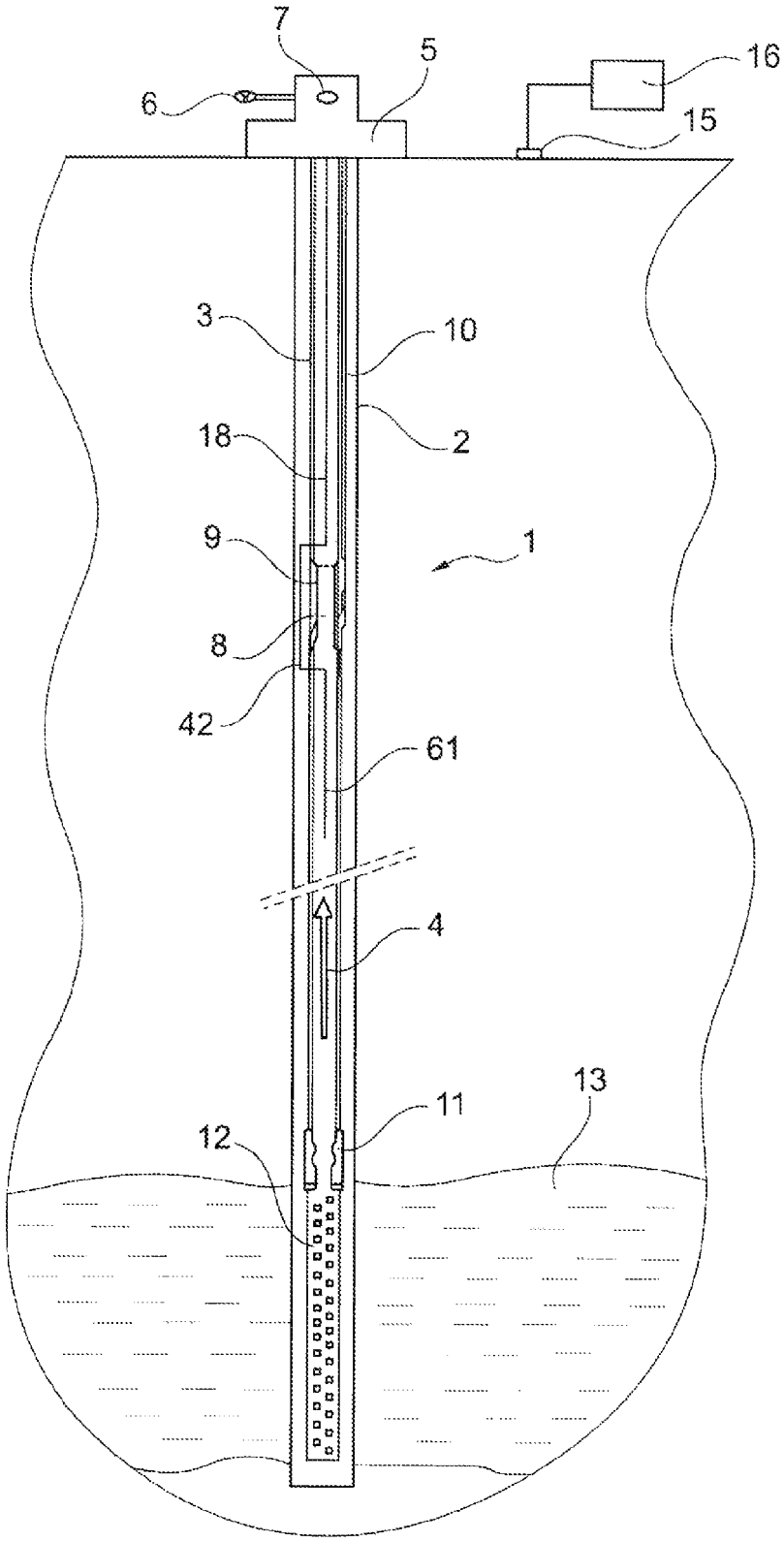
FIG. 1 is a section view showing an effluent-production installation fitted with a safety valve in accordance with the invention.

A detailed description is given below. Various terms that are used herein are defined below. When a term used in a claim is not defined below, it should be given the broadest definition that people skilled in the art give to the term, as shown in printed publications and published patents. In the description below, equivalent elements are referenced throughout the description and in the drawings by means of the same numerical references.

Although the drawings might be to scale, they need not necessarily be to scale, and the proportions of certain elements may be exaggerated in order to show characteristics and details of the invention more clearly. The person skilled in the art of subsurface safety valves will understand that the various embodiments of the invention may be used in all types of subsurface safety valve, including, but not limited thereto: injection valves that are accessible in the column and recoverable by cable; or valves controlled from the surface.

For reasons of clarity, the invention is described in general terms with reference to an installation for producing effluent, which installation extends vertically. Nevertheless, it should be understood that the invention may be employed in a production installation that is open, horizontal, or indeed lateral, without going beyond the principles of the invention. Furthermore, an on-shore installation is shown by way of illustration. Nevertheless, it should be understood that the invention may equally well be used in installations of the off-shore type, or indeed that are drilled in the ground, but under a platform, at sea, or in a lake.

FIG. 1 is a section view of an effluent-production installation 1 where such effluent may, in particular, be oil or gas as mentioned above, but could equally well be water or any other fluid. The installation 1 comprises longitudinal casing 2 receiving a production column 3, which column defines an elongate bore along which effluent may be extracted upwards, as represented by arrow 4.

FIG. 1 also shows a well head 5, a control valve 6, a flow line 7, and a subsurface safety valve 8 in accordance with the invention. This safety valve is mounted in a sleeve 9 and is connected to a control line 10. In conventional manner, the installation 1 also includes a support 11 for a bottom plug and a perforated strainer 12.

In operation, opening the control valve 6 allows effluent to flow from a formation 13 through the perforated strainer 12 and then into the production column 3. An annular zone between the longitudinal casing 2 and the production column 3 is closed in leaktight manner by cement so as to direct the flow of effluent. The effluent flows along the production column 3 through an underground safety valve 8 while the valve is in its open position, and then through the well head 5, and finally to the outside in the flow line 7.

The safety valve 8 is also used to control flow within the production column 3 in selective manner. The safety valve 8 may be moved between an open position and a closed position by supplying it or not supplying it with hydraulic pressure. A pump 15 actuated by a control panel 16 delivers hydraulic pressure to the safety valve 8 via the control line 10. The hydraulic pressure holds the closure mechanism of the flap inside the safety valve 8 in the open position, as described in greater detail below with reference to FIGS. 2 and 3. Finally, in accordance with the invention, a feed line 18 serves to inject an additive downhole, as explained below.

During the production operation, the safety valve 8 remains in the open position. Nevertheless, the flow of effluent may be stopped at any time during the production operation by switching the safety valve 8 from its open position to its closed position. This may be performed either intentionally by the operator ceasing to apply hydraulic pressure via the control line 10, or else as a result of a catastrophic event at the surface, such as an act of terrorism.

Figure 2:
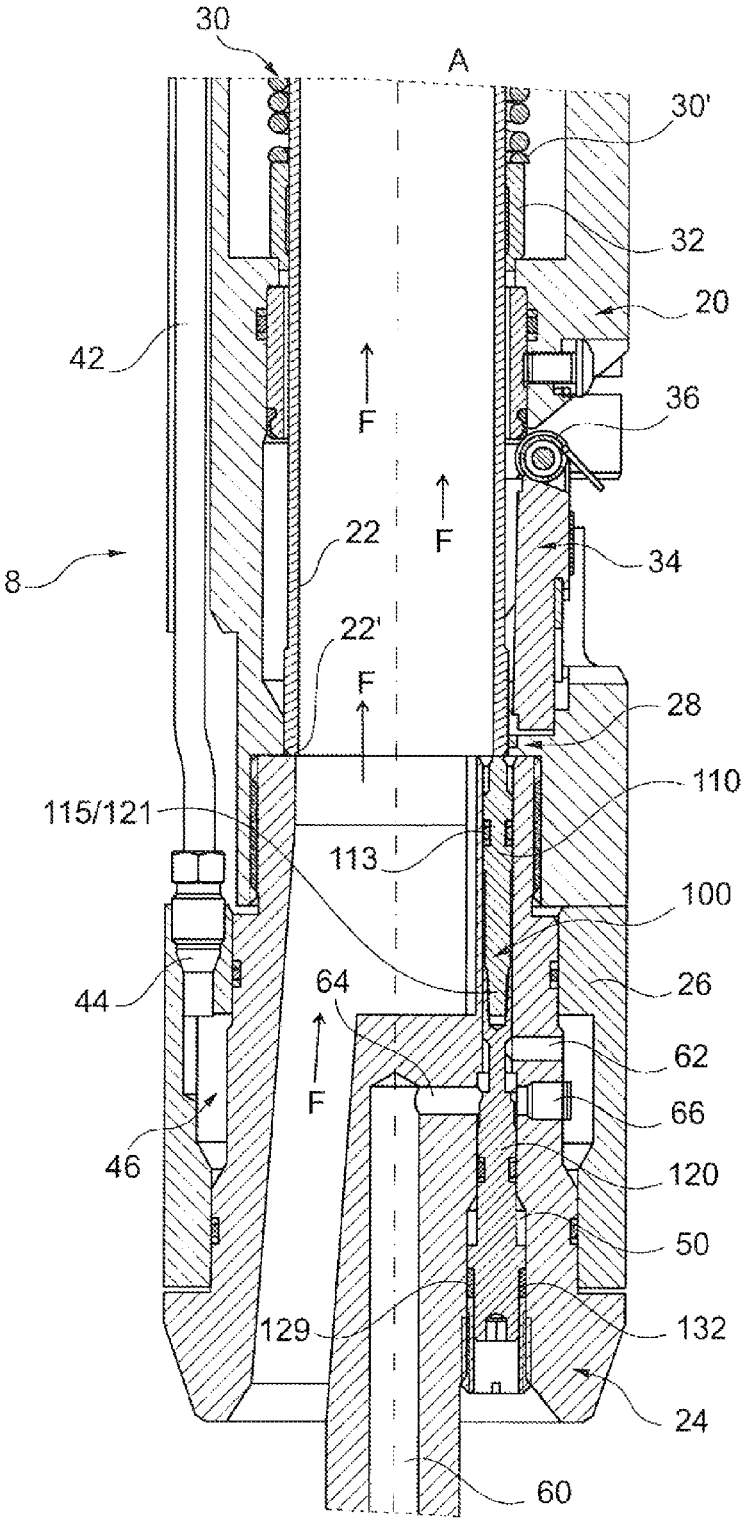
FIGS. 2 and 3 are longitudinal section views showing the downstream end of the underground safety valve of FIG. 1 in two different positions, respectively a normal position and a safe position.
Figure 3:
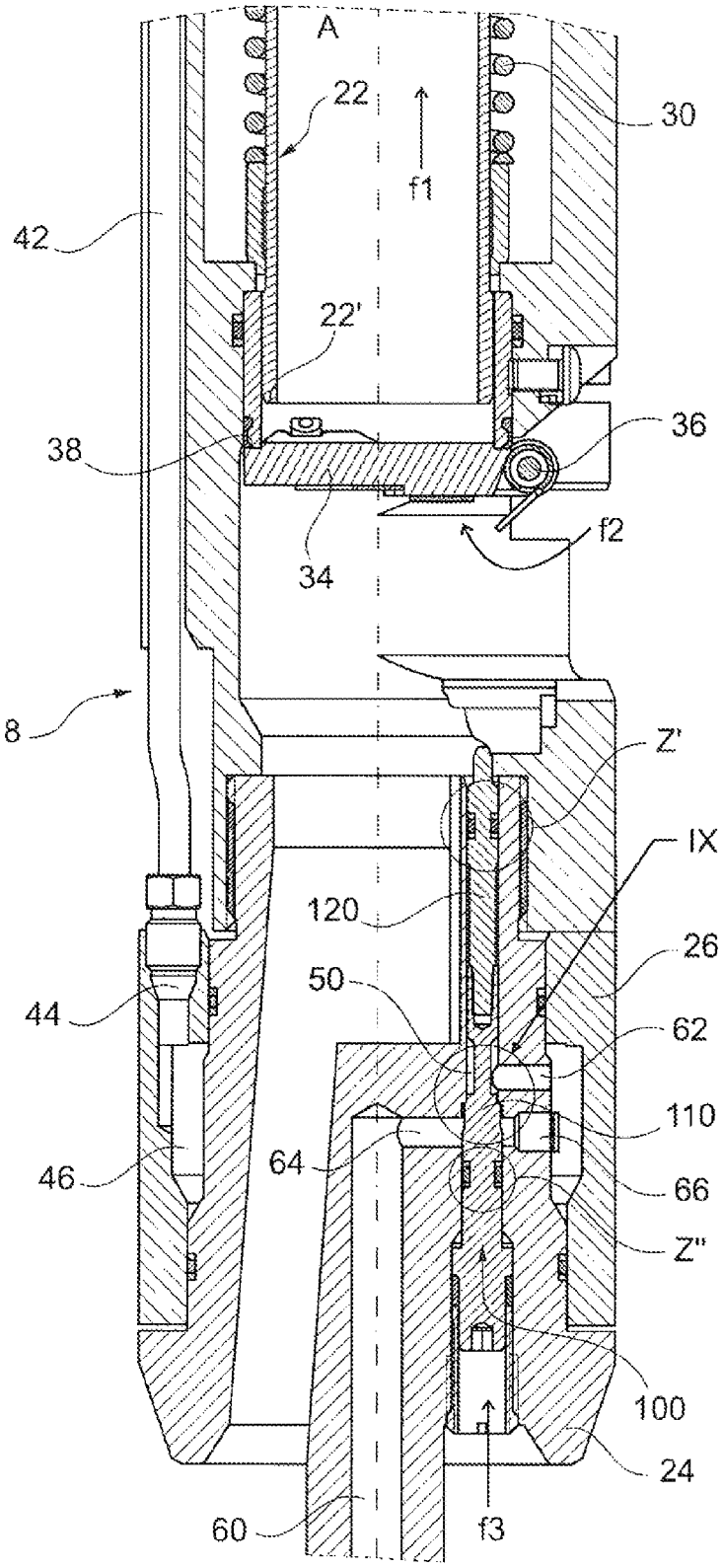
Figure 4:
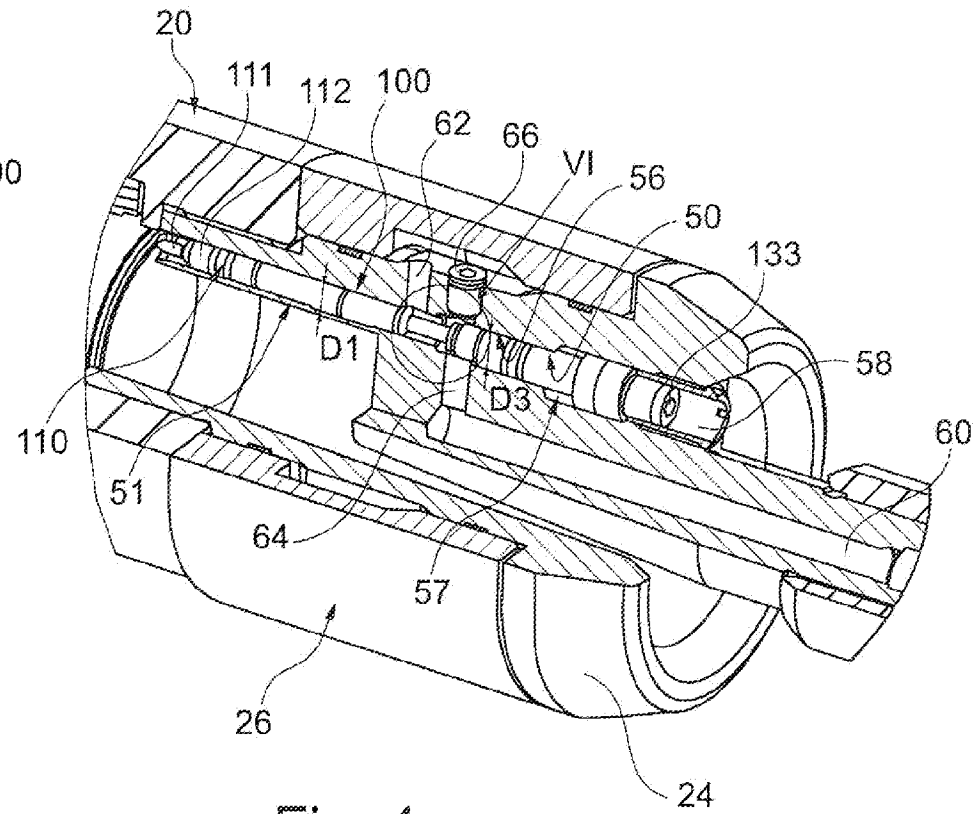
FIGS. 4 and 5 are cut-away perspective views from two different angles and at a larger scale showing the normal position.

FIGS. 2 and 3 show the bottom end of the safety valve 8, i.e. its downstream end, in two different in-use positions that are described below. The safety valve 8 comprises firstly, in known manner, a longitudinal shell 20 forming a hollow body. This body defines a housing for receiving a production tube 22 that extends along the main axis A and along which the effluent rises.

At its downstream end, the longitudinal shell 20 is screwed onto an endpiece 24 that is described in greater detail below, which endpiece is surrounded by a sleeve 26. Furthermore, at its upstream end, the longitudinal shell 20 co-operates with another sleeve 26', as can be seen in particular in FIG. 10. In conventional manner, the safety valve 8 is also associated with an upstream coupling (not shown) serving to connect it with the production column 3.

The two sleeves 26 and 26' are constrained to move in translation with the longitudinal shell 20, while being free to turn relative thereto about its main axis A. This makes assembly easy, in particular for connecting the additive injection pipe, as described in detail below.

The production tube 22 possesses a downstream end 22' that, in the advanced position shown in FIG. 2, co-operates with a centering shoulder 28 that enables said downstream end 22' to be centered. The production tube 22 may be caused to move by the fluid flowing in the control line 10, as mentioned above. In FIGS. 2 and 3, the control line 10 is not shown, it being understood that it is of conventional structure.

The production tube 22 is moved in conventional manner against a return spring 30 (shown in part) that extends over the outer periphery of the production tube 22. The downstream end 30' of the return spring 30 bears against an abutment 32 of the longitudinal shell 20, while its upstream end (not shown) is secured to the production tube 22.

In conventional manner, the production tube 22 is suitable for opening a shutter flap 34 located close to the downstream end of the longitudinal shell 20. This shutter flap 34 may be urged into its closed position by a spring 36, which spring is pivotally mounted about a transverse pin. In this closed position (FIG. 3) the shutter flap 34 rests against a seat 38 of the longitudinal shell 20.

Figure 10:
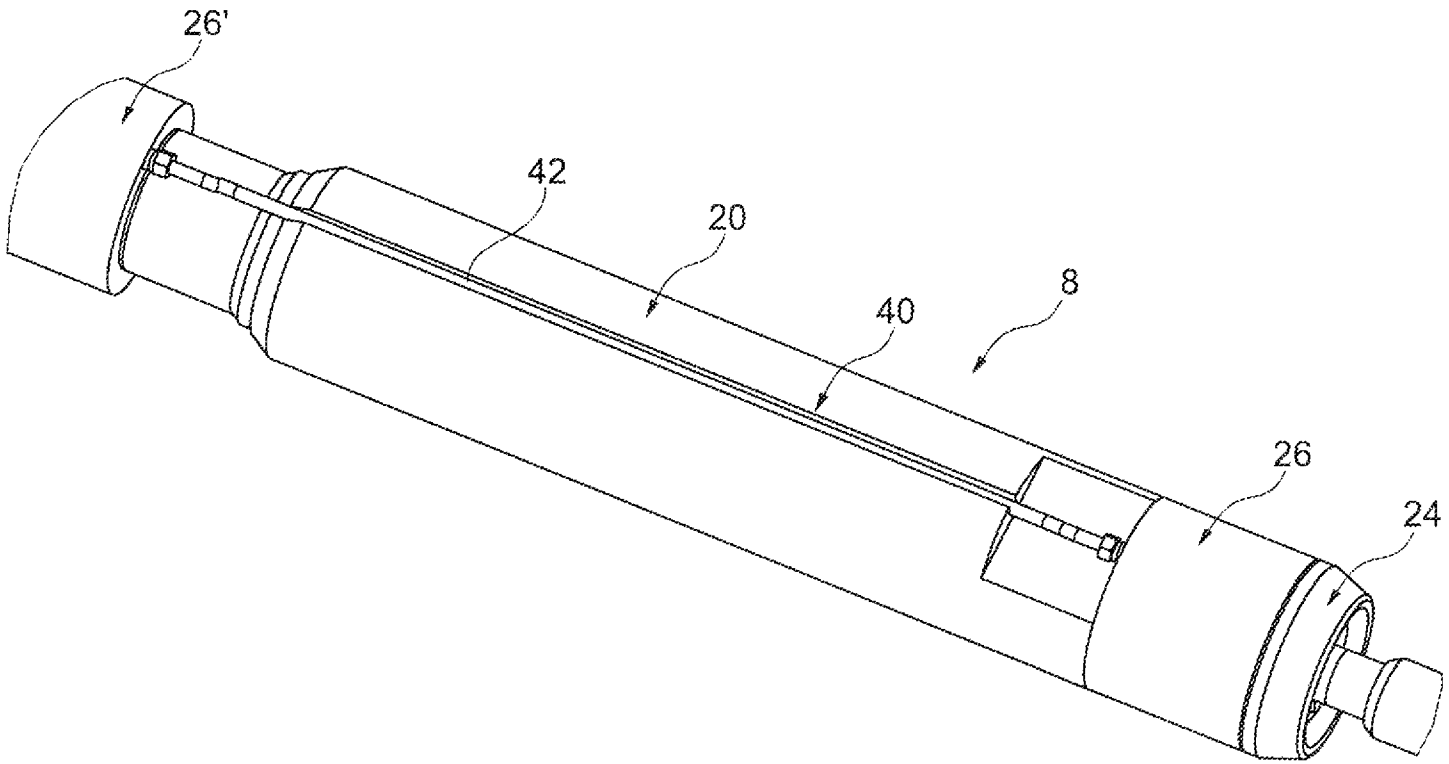
FIG. 10 is an overall perspective view of the safety valve in accordance with the invention.

In its outer periphery, the longitudinal shell 20 is recessed by an axial groove 40 in which there extends a pipe 42 (see also FIG. 10). The pipe is for injecting an additive of conventional type towards the bottom of the well, which additive may in particular be a foam, mud, water, gas, chemicals, and/or other similar fluids.

The upstream end of the pipe 42 is connected to the upstream sleeve 26' that can be seen in FIG. 10 and it is put into communication by any suitable means with a feed line 18, described with reference to FIG. 1. The connection between the pipe 42 and the feed line 18 is implemented in a manner that is independent both from the production tube 22 and from the control line 10. This means that in normal operation the above-mentioned additive is prevented from flowing both in the production tube 22 and in the control line. Furthermore, in such operation, neither the effluent nor the control fluid can flow in the pipe 42.

At its downstream end, the pipe 42 is screw-fastened to the walls of a cavity 44 that is formed in the sleeve 26. This cavity communicates in turn with a peripheral chamber 46 that is defined by the facing walls of the sleeve 26 and of the endpiece 24.

The endpiece 24 is firstly pierced by a channel 50 (described in greater detail below) that extends along a direction parallel to the axis A while being offset therefrom. Furthermore, a first lateral hole 62 connects the peripheral chamber 46 with the channel 50, while a second lateral hole 64 acts, via the channel 50 to connect said peripheral chamber 46 with a downstream bore 60 that extends along the axis A.

The second lateral hole 64, which is located downstream from the first lateral hole 62, is closed by a stopper 66 so as to allow fluid communication solely between the channel 50 and the downstream bore 60. Downstream, the bore 60 opens out into an injection line 61 that is visible more particularly in FIG. 1. The injection line 61 serves to deliver the selected additive at a depth that is much deeper than that of the safety valve 8.

There follows a description in particular with reference to FIGS. 4 to 9 of the various zones of the channel 50 from its upstream end, shown at the top in the figures, to its downstream end, shown at the bottom. Firstly there is an upstream zone 51 of constant diameter D1 that extends as far as the outlet from the upstream first lateral hole 62, and then there are two flow zones 52 and 53, themselves separated by a shoulder 54.

Figure 9:
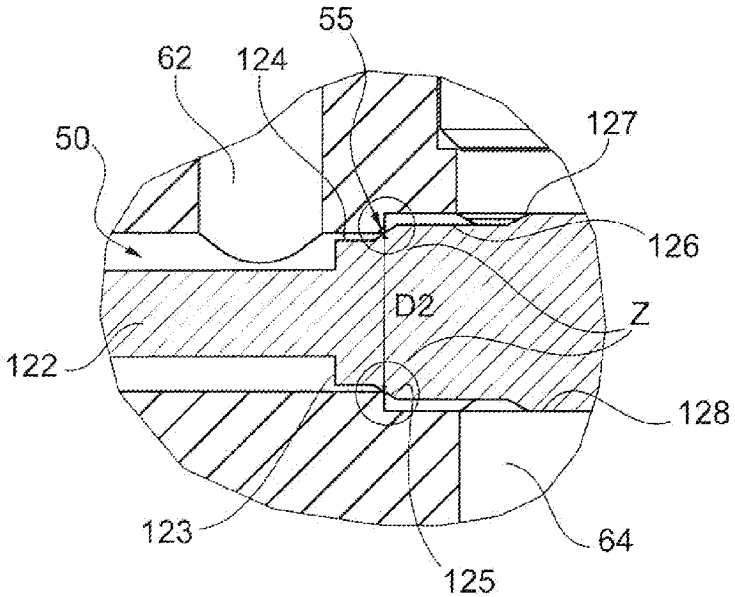
FIG. 9 is a longitudinal section view showing a detail IX of FIG. 3.
Figure 7:
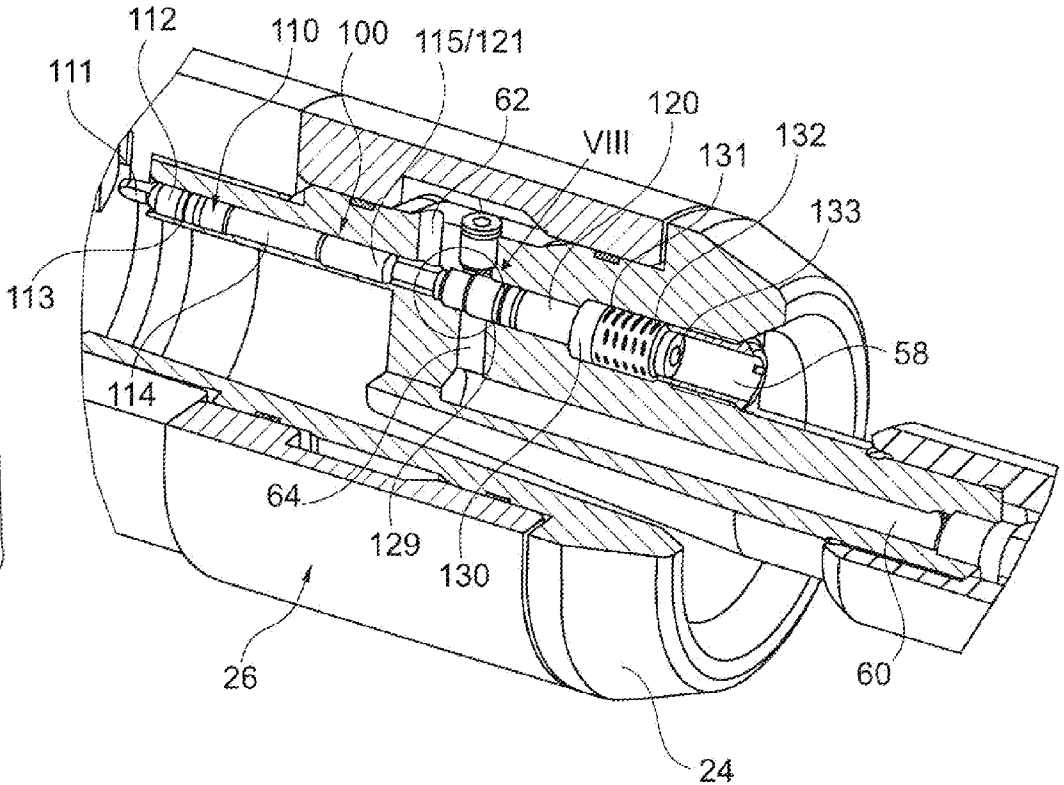
FIG. 7 is a cut-away perspective view showing the safe position (closed) on a larger scale.
Figure 8:
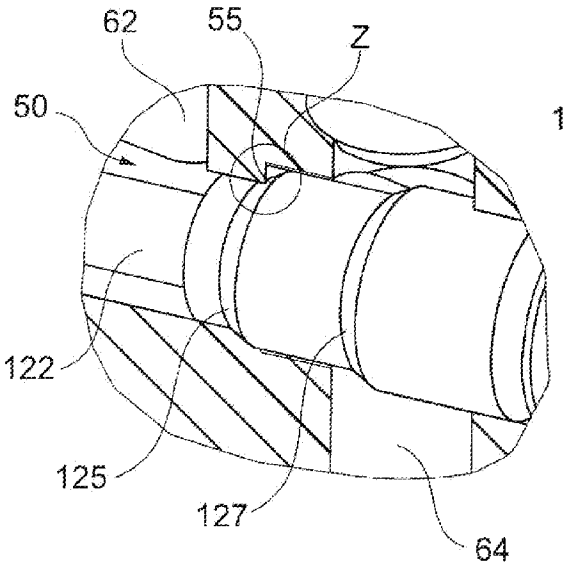
FIG. 8 is a view on an even larger scale showing a detail VIII of FIG. 7.

In longitudinal section as shown in FIG. 9, it can be seen that the shoulder 54 defines a sharp edge 55 that performs a role that is described in greater detail below. The diameter of the channel 50 at this sharp edge 55 is written D2. Finally, downstream from the flow zones 52 and 53 there is the outlet of the downstream second lateral hole 64, then an intermediate zone 56 of constant diameter D3, and finally a downstream zone 57 of greater diameter. A ring 58 that performs a function that is explained below is fitted at the downstream outlet of the channel 50.

The channel 50 receives a safety plug 100 that is made in two portions, an upstream portion 110 and a downstream portion 120. This makes it easy to insert into the channel 50, in particular while preserving the integrity both of the safety plug and of the walls of the channel 50. Nevertheless, it is possible to make provision to use a plug that is made as a single piece.

The upstream portion 110 firstly comprises a tapered end 111 suitable for placing against the centering shoulder 28, and then a sealing segment 112 that is calibrated relative to the upstream zone 51 of the channel 50. For this purpose, the sealing segment 112 has a groove formed therein, which groove receives an upstream gasket 113 of any suitable kind.

The sealing segment is extended by an intermediate segment 114 of smaller section that defines radial clearance relative to the facing walls of the channel 50 both for reasons of economy and in order to reduce friction. Finally, a junction segment 115 is provided that is connected by any suitable means, in particular by screw fastening, to an additional junction segment 121 forming part of the downstream portion 120 of the safety plug 100.

As shown in particular in FIG. 9, this junction segment 121 is extended by a narrower flow segment 122, an outward shoulder 123, an intermediate shank 124, and a sealing segment 125. This sealing segment that presents a frustoconical section flaring downstream is designed to co-operate with the sharp edge 55 around the channel 50. In a variant, provision may be made for the sharp edge to be formed on the body of the flap, with the frustoconical surface then being defined by the wall of the channel.

Thereafter there is a second intermediate shank 126, a second frustoconical section 127, and then a sealing segment 128 that is received in calibrated manner in the intermediate zone 56 of the channel 50. For this purpose, a gasket 129 is provided that co-operates with the facing walls of the channel 50.

Finally, there is a terminal segment 130 of greater diameter that extends in the downstream zone 57 of the channel 50. This segment 130 defines a shoulder 131 against which there bears one end of a spring 132 having its other end resting against the ring 58. The downstream front face of the safety plug 100 has a socket 133 formed therein suitable for co-operating with an appropriate tool for the purpose of tightening together the two component portions of the safety plug 100.

The use of the above-described safety valve 8 is described below.

The operation of this safety valve 8 is explained with reference to FIGS. 2, 4, 5, and 6. Control fluid is injected under pressure via the line 10 so as to move the production tube 22 downstream and thereby open the shutter flap 34. In conventional manner, effluent can then rise in the inside volume of the production tube 22 along arrows F.

Furthermore, during such operation, the free end 22' of the production tube 22 pushes the safety plug 100 against the spring 132. Consequently, the sealing segment 125 is at a distance from the sharp edge 55, as shown in FIG. 6, so as to leave a passage between them.

Under such conditions, the operator may inject an additive from the surface downhole. The additive flows from the feed line 18, successively along the pipe 42, through the cavity 44, and then through the peripheral chamber 46. Thereafter it passes through the lateral hole 62 and runs into the channel 50 via the narrower segment 122 of the safety plug 100.

Figure 6:
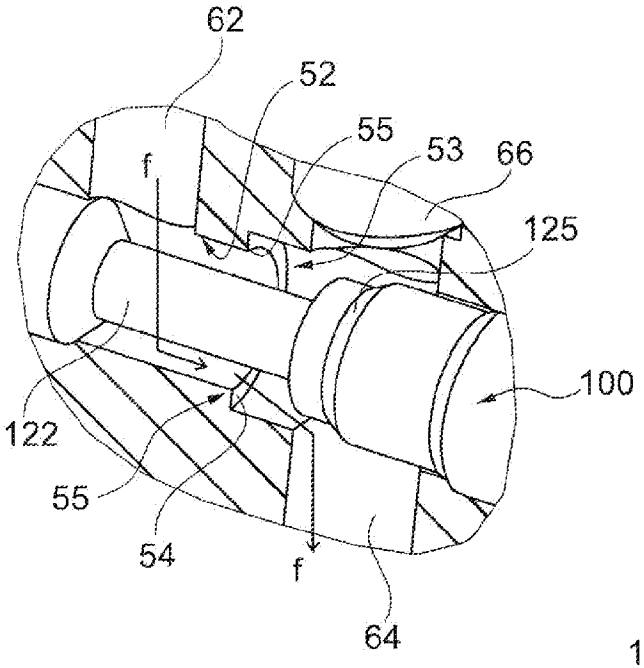
FIG. 6 is a view on an even larger scale showing a detail VI of FIG. 4.
Figure 5:
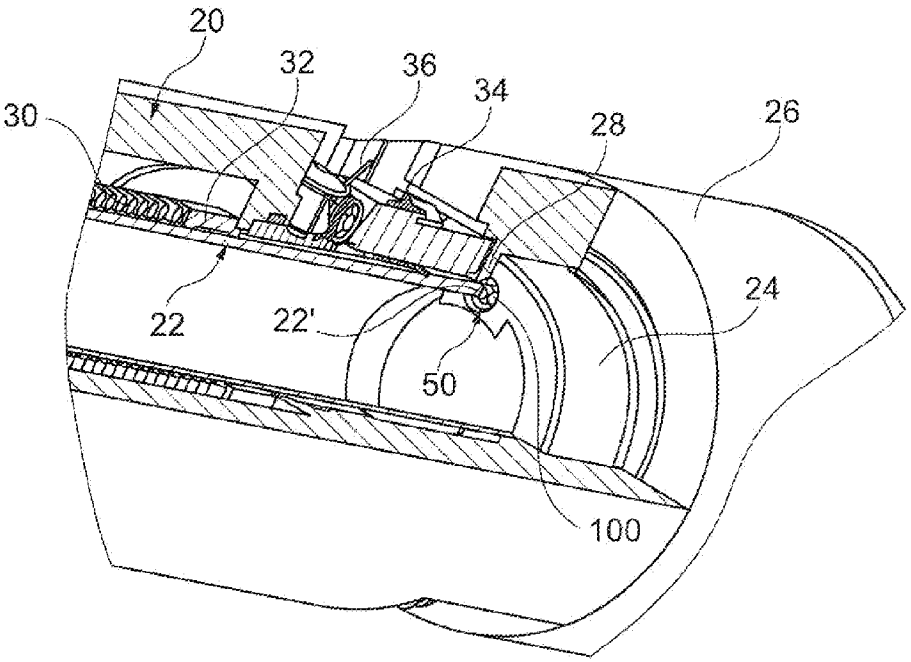

The additive then flows along arrows f in FIG. 6, i.e. it follows the passage provided between the sharp edge 55 and the sealing segment 125, and it then travels via the second lateral hole 64 towards the downstream bore 60. The various mechanical members that enable fluid to be transferred from the surface down to the bottom of the well form an additive injection assembly in the meaning of the invention.

It is assumed below that the operation of the safety valve 8 is no longer normal, i.e. that it is in one of the conditions listed above, known as well safety conditions. The control fluid no longer flows in the control line 10 or, at least, not at sufficient pressure, such that the return spring 30 tends to return the production tube 22 upwards in the direction of arrow f1 in FIG. 3. This retraction of the production tube 22 causes the shutter flap 34 to pivot under drive from its own return spring 36 in the direction of arrow f2 in FIG. 3.

Furthermore, the upward movement of the production tube 22 means that its free end 22' no longer acts on the safety plug 100. The spring 132 then returns the safety plug 100 upwards, along arrow f3 in FIG. 3 until the segment 125 presses against the sharp edge 55, thereby defining a sealing zone Z, referred to as a main sealing zone in the meaning of the invention (see FIG. 9).

The zone Z is formed by co-operation between a sharp edge and a truncated cone, as seen in section. This makes it possible to impart highly effective sealing to the seal obtained in this way.

Consequently, no fluid can flow between the lateral hole 62 and the downstream bore 60 in one direction or the other. In other words, the safety plug 100 moves from its open position to its closed position when the production tube 22 moves from its advanced position to its retracted position.

In accordance with the invention, it is ensured in particular that effluent does not rise from the bottom of the well to the surface via the pipe 42 and the additive injection line 18. The invention thus makes it possible to avoid any risk of unwanted leakage of effluent, of the kind that might lead to catastrophic phenomena of the "oil spill" type.

The movement of the safety plug 100 from its FIG. 2 position to its FIG. 3 position is influenced by the difference, if any, between the diameters D1 and D3 relating to the secondary sealing zones Z' and Z" that are referenced in FIG. 3 and that are located on either side of the lateral holes 62 and 64.

Thus, it is preferable firstly for D3 to be close to or greater than D1. If D3 is less than D1, then the movement of the safety plug 100 is particularly difficult to achieve.

Furthermore, if D3 is greater than D1, the presence of the spring 132 is optional since the downhole pressure suffices on its own to raise the safety plug 100.

Finally, if D3 is close to D1, then the presence of the spring 132 is useful for performing this movement.

In addition, the stability of the safety plug 100 in its FIG. 3 position is influenced by the difference, if any, between the diameters D1 and D2.

Thus, if D2 is less than D1, any additive that might arise from upstream via the downstream hole 62 will contribute to reinforcing the sealing created at the sharp edge 55.

Furthermore, if D2 is close to D1, any additive that arrives has no influence on the sealing.

Finally, if D2 is greater than D1, then any additive that arrives tends to push the sealing segment 125 back away from the sharp edge 55, such that it then becomes necessary to ensure that the return spring is appropriately dimensioned. This embodiment may nevertheless be advantageous for injecting additive when the safety valve is closed.

The above description relates to closing the safety plug 100 when the production tube 22 is retracted. Thereafter, if operating conditions return to normal, fluid is injected once more via the control line 10 so as to move the production tube 22 axially. This then causes the shutter flap 34 to open, and then via a driving connection pushes the safety plug 100 back towards its open position as shown in FIG. 2. In other words, the safety plug 100 moves from its closed position to its open position under the effect of the production tube 22 passing from its retracted position to its advanced position.

It is also possible to make provision in the safety valve for an arrangement of the duct connecting together the feed line and the additive injection line that is of the annular type, being coaxial with the production tube, and without going beyond the ambit of the invention.

While the foregoing is directed to embodiments of the invention, other and further embodiments of the invention may be devised without departing from the basic scope thereof, and the scope thereof is determined by the claims that follow.

The invention claimed is:

1. A safety valve for an effluent-production installation, the safety valve comprising:

a longitudinal shell in which there extends a production tube defining an inside volume for effluent flow, the production tube being movable in translation inside the longitudinal shell in an axial direction between an advanced position in which effluent flow is authorized from the bottom of the installation towards the surface, and a retracted position in which effluent flow is prevented;

a connection duct between a feed line for feeding at least one additive from the surface and an injection line for injecting the additive downhole; and a safety plug being provided in the connection duct and being movable in translation along the axial direction in which the production tube moves in order to close or open the connection duct depending on whether the production tube is in its retracted position or its advanced position, the production tube being arranged to push the safety plug in said axial direction on passing from its retracted position towards its advanced position, the movement driving between the production tube and the safety plug being a mechanical connection by contact.

2. The safety valve of claim 1, wherein the safety plug is mounted to move in the connection duct between a closed position in which it closes the connection duct and an open position in which said feed line and injection line are in communication with each other, the safety plug being drivingly connected with the production tube to pass from its closed position to its open position when the production tube passes from its retracted position to its advanced position.

3. The safety valve of claim 1, wherein return means are provided for returning the safety plug to its closed position, which return means move the safety plug from its open position to its closed position when the production tube is moved from its advanced position towards its retracted position.

4. The safety valve of claim 3, wherein the safety plug is movable in a channel and acts in its closed position to define a main sealing zone formed by co-operation between a sharp edge belonging to a wall of the channel or to the safety plug, and a frustoconical surface belonging to the safety plug or to a wall of the channel.

5. The safety valve of claim 4, wherein the channel opens out towards the inside volume of the production tube.

6. The safety valve of claim 4, wherein the connection duct includes two lateral flow holes opening out into said channel, which flow holes are disposed on either side of the main sealing zone.

7. The safety valve of claim 6, wherein two secondary sealing zones are provided in addition to the main sealing zone, being located on either side of the two lateral holes.

8. The safety valve of claim 6, wherein the section of the secondary sealing zone facing downhole is greater than or equal to the section of the secondary sealing zone facing towards the surface.

9. The safety valve of claim 8, wherein the section of the secondary sealing zone facing downhole is greater than the section of the secondary sealing zone facing towards the surface, the return means for the plug being provided by a pressure difference.

10. The safety valve of claim 3, wherein the return means comprises a mechanical, resilient type member.

11. The safety valve according to claim 1, wherein the connection duct includes a pipe fitted on two sleeves placed at opposite ends of the longitudinal shell, the sleeves being constrained to move in translation with the longitudinal shell while being free to move in rotation relative to said longitudinal shell.

12. The safety valve of claim 1, wherein the safety plug is made of two distinct elements suitable for being releasably connected together by screw fastening.

13. An effluent-production installation, comprising:

a production column; and the safety valve of claim 1 housed in said production column.

* * * * *